US005161456A

United States Patent [19]

Ehrlinger et al.

[11] Patent Number: 5,161,456

[45] Date of Patent: Nov. 10, 1992

[54] APPARATUS FOR MIXING A FLUID WITH A LIQUID

[75] Inventors: Klaus Ehrlinger, Fröndenberg; Heinz Hinze, Beckum, both of Fed. Rep. of Germany

[73] Assignee: APV Rosista GmbH, Unna-Konigsborn, Fed. Rep. of Germany

[21] Appl. No.: 702,901

[22] Filed: May 17, 1991

[30] Foreign Application Priority Data

May 24, 1990 [DE] Fed. Rep. of Germany ..... 4016727

[51] Int. Cl.[5] ..... B01F 3/04

[52] U.S. Cl. ..... 99/323.2; 366/336; 366/340; 261/44.1; 261/DIG. 7

[58] Field of Search ..... 99/323.1, 323.2, 275; 261/44.1, 113, DIG. 7; 366/160, 162, 167, 172, 173, 178, 179, 337, 336, 152, 182

[56] References Cited

U.S. PATENT DOCUMENTS

| | | | |
|---|---|---|---|
| 2,245,200 | 6/1941 | Johnson | 366/336 |
| 2,391,110 | 12/1945 | Walker | 366/340 |
| 2,441,419 | 5/1948 | Hudson | 261/DIG. 7 |
| 2,457,903 | 1/1949 | Kantor et al. | 99/323.2 |
| 2,699,718 | 1/1955 | Wright | 99/275 |
| 3,219,483 | 11/1965 | Goos et al. | 366/148 |
| 3,488,037 | 1/1970 | Prochazka et al. | 261/113 |
| 4,226,543 | 10/1980 | Schlüter | 366/179 |
| 4,299,655 | 11/1981 | Skaugen | 366/336 |
| 4,474,477 | 10/1984 | Smith et al. | 366/178 |

FOREIGN PATENT DOCUMENTS

| | | |
|---|---|---|
| 366518 | 2/1963 | Switzerland . |
| 431465 | 2/1966 | Switzerland . |
| 664703 | 3/1985 | Switzerland . |
| 729226 | 5/1955 | United Kingdom . |
| 1126682 | 9/1968 | United Kingdom . |
| 1320746 | 11/1971 | United Kingdom . |
| 2096911 | 10/1982 | United Kingdom . |

*Primary Examiner*—Harvey C. Hornsby
*Assistant Examiner*—James F. Hook
*Attorney, Agent, or Firm*—Herbert Dubno

[57] ABSTRACT

A device for mixing a fluid, for example, carbon dioxide, with a liquid, for example an aqueous beverage solution has a combining part in which one or more infusion chambers are formed within a cylinder by to chamber through diaphragm orifices in these plates and the liquid is injected through radial bores in the cylinder wall which can be controlled by collars formed on the edges of the plates. The gas is introduced into the upstream chamber through another radial port. Downstream of the combining part, the mixture flows through an in-line mixer having walls provided with turbulence inducing formations and one of which is movable with the stem.

16 Claims, 3 Drawing Sheets

APPARATUS FOR MIXING A FLUID WITH A LIQUID

FIELD OF THE INVENTION

Our present invention relates to an apparatus or device for the mixing of a fluid, e.g. a gas or liquid with another fluid, usually a liquid, especially for the formation of carbonated beverages. More particularly, the invention relates to the incorporation of carbon dioxide, as a fluid as aforementioned, in an aqueous system, e.g. water, for the preparation of a carbonated beverage.

As indicated, for the purposes of the present invention "a fluid" as this term is used herein can be a gas, a liquid, a gas mixture, a liquid mixture and/or a gas/liquid mixture. Correspondingly, when the term "liquid" is used herein, we intend to include not only pure liquids but also liquid mixtures. Devices of the type described are intended primarily for the incorporation of carbon dioxide in an aqueous beverage, i.e. a so-called carbonating system.

BACKGROUND OF THE INVENTION

Carbonating systems for the purposes described and known in the art generally, comprise a combining part in which the carbon dioxide and the liquid are initially combined and an in-line mixing part connected with the combining part and provided with turbulence inducing formations for increasing the intensity with which the gas phase is dispersed in the liquid.

In such systems, the fluid, e.g. carbon dioxide, is injected into the liquid, especially a beverage, and the mixture which thus results is subjected to intensive mixing in the subsequent in-line mixing part or mixer of the device.

A drawback of such devices is that the carbonizing effect of any particular apparatus of this type is only satisfactory for a predetermined throughput. With other throughputs, especially increased throughputs, the degree of carbonization or carbonation may be unsatisfactory. In systems used in bottling or filling installations, a wide range of throughputs may be desired and for this purpose, earlier systems having an in-line mixing part downstream of the combining part having not proved to be satisfactory. It is either necessary to replace the apparatus with another design for the different throughputs or to provide some sort of buffer system downstream of the carbonizing system, thereby drastically increasing the cost.

OBJECTS OF THE INVENTION

It is, therefore, the principal object of the present invention to provide a carbonizing or carbonating system for the purposes described which will be free from this drawback, i.e. will allow the effective production of carbonated beverage with a wide range of throughputs.

It is a more general object of our invention to provide a device for mixing a fluid, as defined, with a liquid, as defined, with a wide range of throughputs and with effective dispersal of the fluid within the liquid.

Still another object of the invention is to provide a system of the type described which will have a substantially constant liquid-charging effect for charging a liquid with a gas, for a wide range of liquid throughputs.

Still another object of the invention is to provide an apparatus for charging a liquid with a gas which will avoid disadvantages of earlier systems.

SUMMARY OF THE INVENTION

These objects and others which will become apparent hereinafter are attained, in accordance with the invention by providing the combining part of the apparatus with at least one infusion chamber defined by a cylinder wall and receiving the gas through a supply opening in this wall at an upstream side of the chamber, while, at a downstream side of the chamber, radial apertures inject the liquid phase into the chamber. The flow cross section of these apertures can be altered by the axial displacement of a chamber-closure plate within the cylinder.

More particularly, the invention encompasses an apparatus for mixing a fluid with a liquid which comprises:

combining means for combining a liquid with a fluid and including:

means forming a cylinder having a cylinder wall extending along an axis and defining at least one infusion chamber, inlet means communicating with the chamber at an upstream location for introducing the fluid into the infusion chamber, at least one radial aperture in the wall at a downstream location for injecting the liquid into the chamber, a chamber-closure plate spanned across the cylinder, axially displaceable in the cylinder and delimiting the chamber at a downstream end thereof, the plate having an outer edge controlling a flow cross section of the aperture and at least one discharge opening for discharging a mixture of the fluid with the liquid, and means connected with the plate for axially displacing same in the cylinder; and an in-line mixer connected to the cylinder for receiving the mixture from the chamber and intensifying mixing of the fluid with the liquid as the mixture flows through the in-line mixer.

Our invention is based upon our discovery that the injection of a liquid into the gas through radial apertures of adjustable cross section, can permit, in the context of the system as described, a constant charging or mixing effect with widely varying throughputs. Tests have shown that the invention in a relatively simple manner permits accommodation of a liquid charging system to a wide range of throughputs.

According to a feature of the invention, the edge of the chamber-closure plate is formed with a collar which can slide along the wall of the cylinder and converges in a direction opposite to the direction of flow through the chamber to a sharp edge or vertex.

The mixing effect can be further improved by forming the outlet openings in the plate as diaphragm orifices through which the mixture passes in a highly turbulent manner.

Since it cannot be excluded that contaminants might enter between the cylinder wall and the outer edge, according to a preferred embodiment of the invention, the cylinder wall is formed immediately downstream of the radial apertures of each chamber with circumferential, inwardly opening cleaning grooves which have a height greater than that of the collar and thus of the outer edge of the plate. When the outer edge of the plate, therefore, registers with this groove, a flow of liquid is directed around the edge and can sweep the groove clear of such contaminants.

Depending upon the nature of the fluid/liquid combinations to be made even one infusion chamber may suffice in the combining part of the apparatus. In other cases, for example, for the charging of a water containing beverage with carbon dioxide a plurality of such chambers in succession may be desirable. In a best-mode embodiment for this purpose, four injection chambers disposed axially in succession can be provided.

In the first chamber the fluid is fed under conditions above the saturation equilibrium so that a two-phase mixture is formed. This has been found to be advantageous also with respect to noise reduction. In the further stages back dilution occurs until the desired fluid concentration is achieved.

The chamber-closure plates of all of the infusion chambers can be connected to or mounted upon a common central adjusting rod so that only a single positioning device or drawer is required for the positioning of the chamber-closure plates of the respective chambers. Liquid supply to the apertures can be effected through an annular compartment surrounding the cylinder wall and communicating with these apertures.

The fluid supply bore opening into the first infusion chamber can also be formed at an upstream end in the cylinder wall while the positioning device can be provided at the upstream end of the cylinder assembly.

The positioning rod can be displaced in dependence upon external signals (pressure, throughput) or in response to an internal system pressure, e.g. in response pressure detected by a control membrane exposed to the pressure at the upstream end of the cylinder wall.

According to a further embodiment of the invention which may have independent significance and does not require the particular configuration of the combining part of the apparatus as described, the in-line mixer may comprise at least one annular compartment axially traversed by the mixture and defined between two opposite walls having complementary turbulence-inducing formations.

According to a feature of the invention, the outer one of these walls is formed as an extension of the cylinder wall and an inner one of the opposite walls is formed as a body, e.g. another cylinder, axially displaceable within the outer wall. This body can be mounted on the rod. The formations can be radial flanges so juxtaposed that the body can be shifted into a position blocking flow through the in-line mixer. The formations can, alternatively, have sawtooth profiles.

BRIEF DESCRIPTION OF THE DRAWING

The above and other objects, features and advantages of our invention will become more readily apparent from the following description, reference being made to the accompanying highly diagrammatic drawing in which:

FIG. 1 is a diagrammatic longitudinal section through an apparatus according to the invention;

DESCRIPTION

Figure 1A:
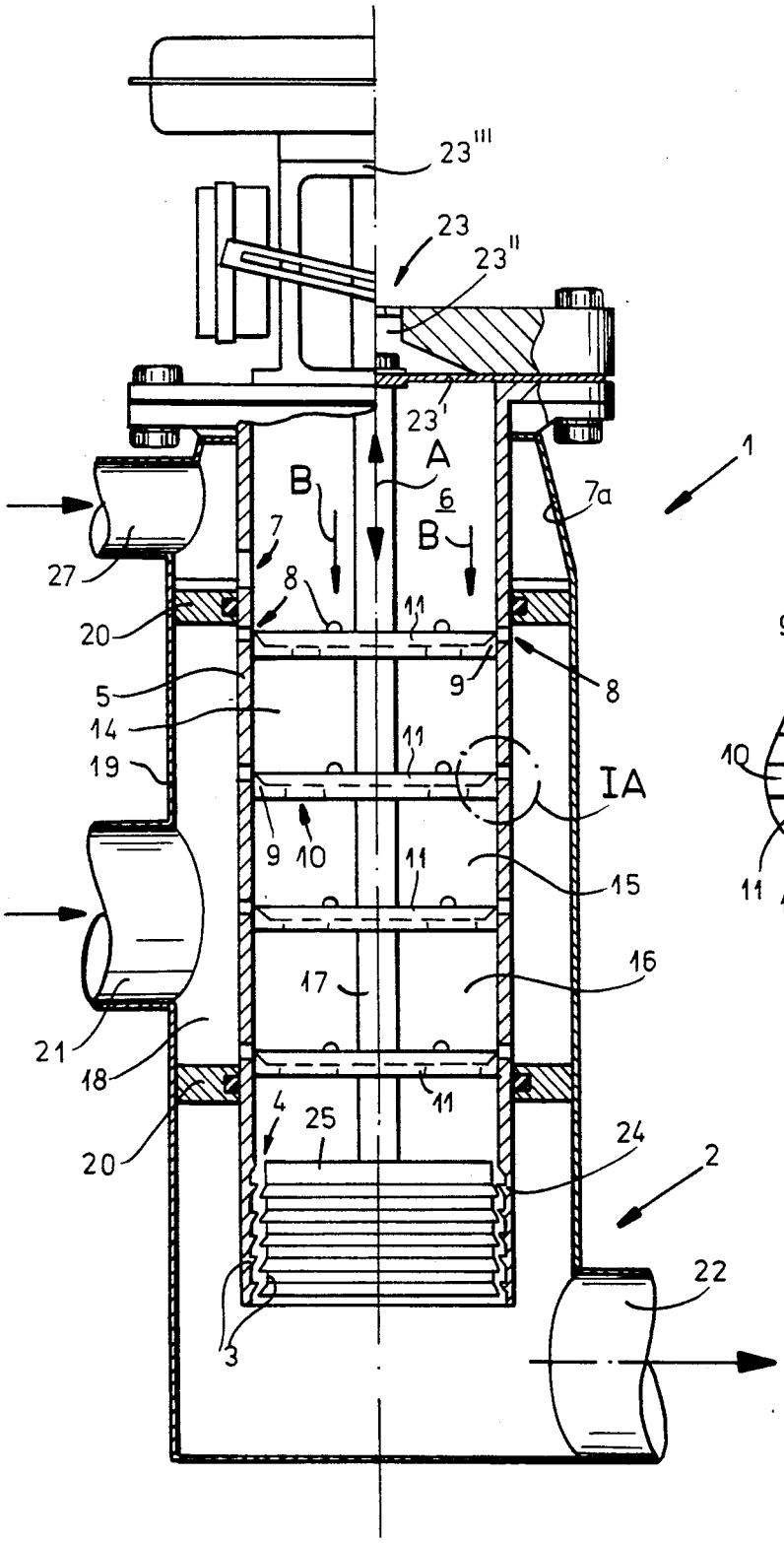
FIG. 1A is a detail view of the region IA of FIG. 1.

The device shown in the drawing for mixing a fluid, usually carbon dioxide, with a liquid, usually an aqueous beverage liquid which can be a mixture of a beverage syrup and water, basically comprises a combining part 1 and an in-line mixer 2 connected to this combining part 1 and forming an annular chamber 4 which is defined between walls provided with turbulence-inducing formations 3.

Figure 1A:
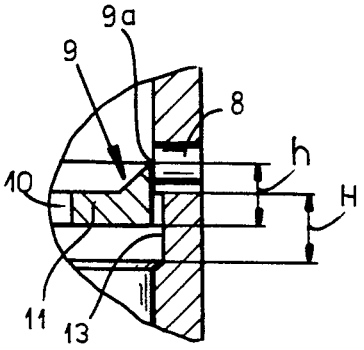

The combining part 1 is a cylinder defined by cylinder wall 5 in which a first infusion chamber 6 is delimited by an axially movable chamber-closure plate 11, i.e. the upper plate of the assembly is shown in FIG. 1.

Relatively upstream in this chamber, a fluid opening 7 in the form of a radial port in the cylinder wall 5 is provided. This port communicates with an annular compartment *7a* which, in turn, is connected to a source of this fluid by a pipe 27. This source can be a carbon dioxide tank.

At a downstream side of this chamber, a plurality of radial apertures 8 in angularly equispaced relationship about the axis of the cylinder are provided in the wall 5 and serve for the injection of the liquid into the chamber 6. The apertures 8 communicate with an annular compartment 18 distributing the liquid and connected to a source thereof via the pipe 21.

The cross sections of the radial apertures 8, all of which lie in a common horizontal plane perpendicular to the axis of the cylinder for the respective chamber, we provide on the plate 11 an outer edge 9 in the form of an upwardly extending collar which, as can be seen from FIG. 1A, converges upwardly to a sharp edge *9a*. The closure plate 11 is axially shiftable as represented by the arrow A and is provided with diaphragm-like orifices 10 allowing the mixture to pass axially.

As is apparent from FIGS. 1 and IA, the collar 9 converges in a direction opposite the flow direction represented by the arrows B. By forming the orifices 10 as diaphragm orifices, we can ensure additional turbulence downstream of each orifice as a result of the acceleration of flow therethrough.

Below each coplanar array of radial bores 8, the cylinder wall 5 is also provided with a circumferential inwardly open cleaning groove 13 whose height H is greater than the height h of the outer edge or collar 9.

Below the first infusion chamber 6, the mixture traverses three additional infusion chambers 14, 15 and 16 which are arranged axially in succession and are identical, being delimited by the respective chamber-closure plates 11. These additional chambers are supplied by the mixture from the preceding chamber and with additional liquid through respective sets of radial apertures 8 communicating with the annular distributing chamber 18.

All of the chamber-closure plates 11 are mounted upon a central adjusting rod 17 so that they can be moved jointly axially.

The chamber 18 is defined between a pair of annular flanges or partitions 20 and is surrounded by an outer cylinder wall 19 formed not only with the pipe connections 21 and 27 which have previously been described, but also with a further pipe connections 22 for delivering the mixture to the bottling stations or the like.

At the upstream end of the cylinder, a control membrane or other servomechanism or positioning drive 23 forms a positioner connected to the rod 17. In FIG. 1, the membrane is represented at 23' at the right hand half of the device and has a chamber 23'' which can be pressurized to shift the rod 17 as represented by the arrow A. On the left-hand side of FIG. 1 a positioner 23''' which can be hydraulic or pneumatic and can include a piston cylinder arrangement has been illustrated.

Figure 5A:
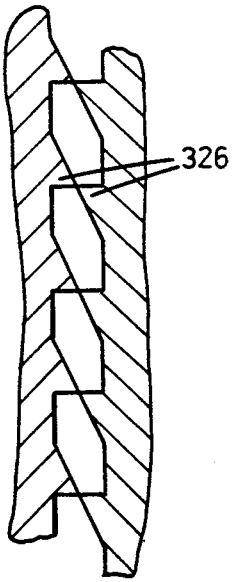
Figure 5B:
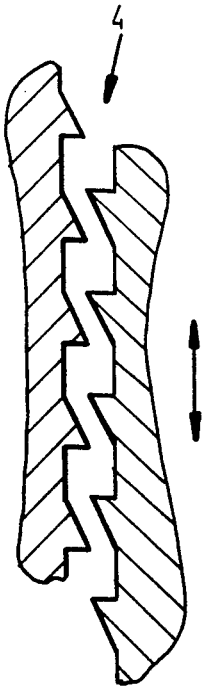

In the embodiment of FIG. 1, the outer wall of the in-line mixer 2 defining the annular chamber 4 is formed as an extension 24 of the cylinder wall 5 while the inner wall is defined by a cylinder body 25 mounted upon the rod 17. The formations 3 are here formed as spaced apart sawteeth (see also FIGS. 5A and 5B).

Other turbulence inducing formations can be provided as well.

Figure 2A:
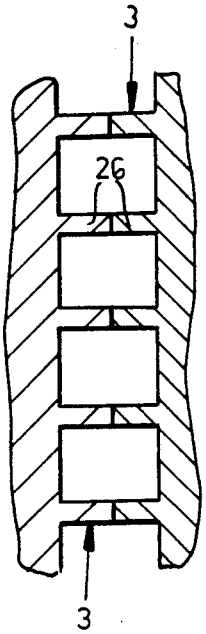
FIGS. 2A and 2B represent relative positions of the opposite walls for blocking flow and for maximizing flow therethrough according to the invention.
Figure 2B:
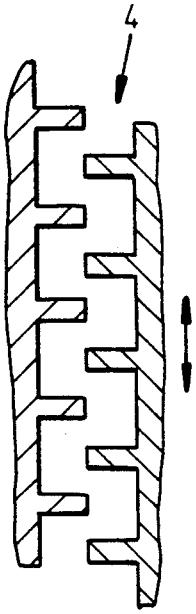
Figure 3A:
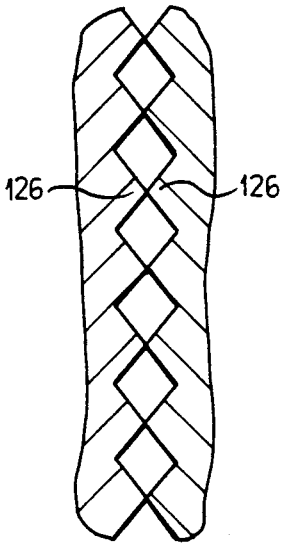
FIGS. 3A and 3B, FIGS. 4A and 4B and FIGS. 5A and 5B represent similar views for different embodiments of the opposite walls of the in-line mixer of the invention.
Figure 3B:
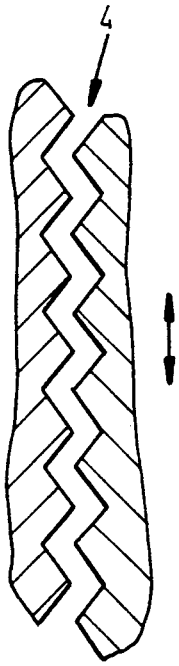
Figure 4A:
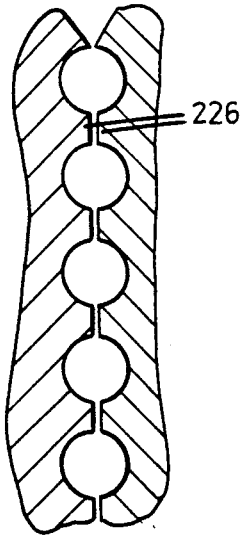
Figure 4B:
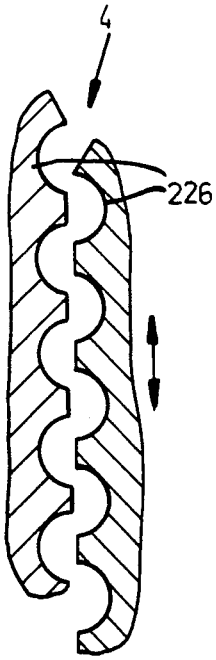

For example, in FIGS. 2A and 2B, these formations are radial flanges 26. In FIGS. 3A and 3B the formations 126 are complementary sawteeth whereas in FIGS. 4A and 4B the formations 226 are semicircular in cross section as opposed to the triangular cross section of the formations 126. In all embodiments, the inner and outer formations can practically close on one another (compare FIGS. 2B, 3B, 4B and 5B with FIGS. 2A, 3A, 4A, 5A, respectively) so that a wide range of throughputs can be accommodated by the apparatus.

Figure 6:
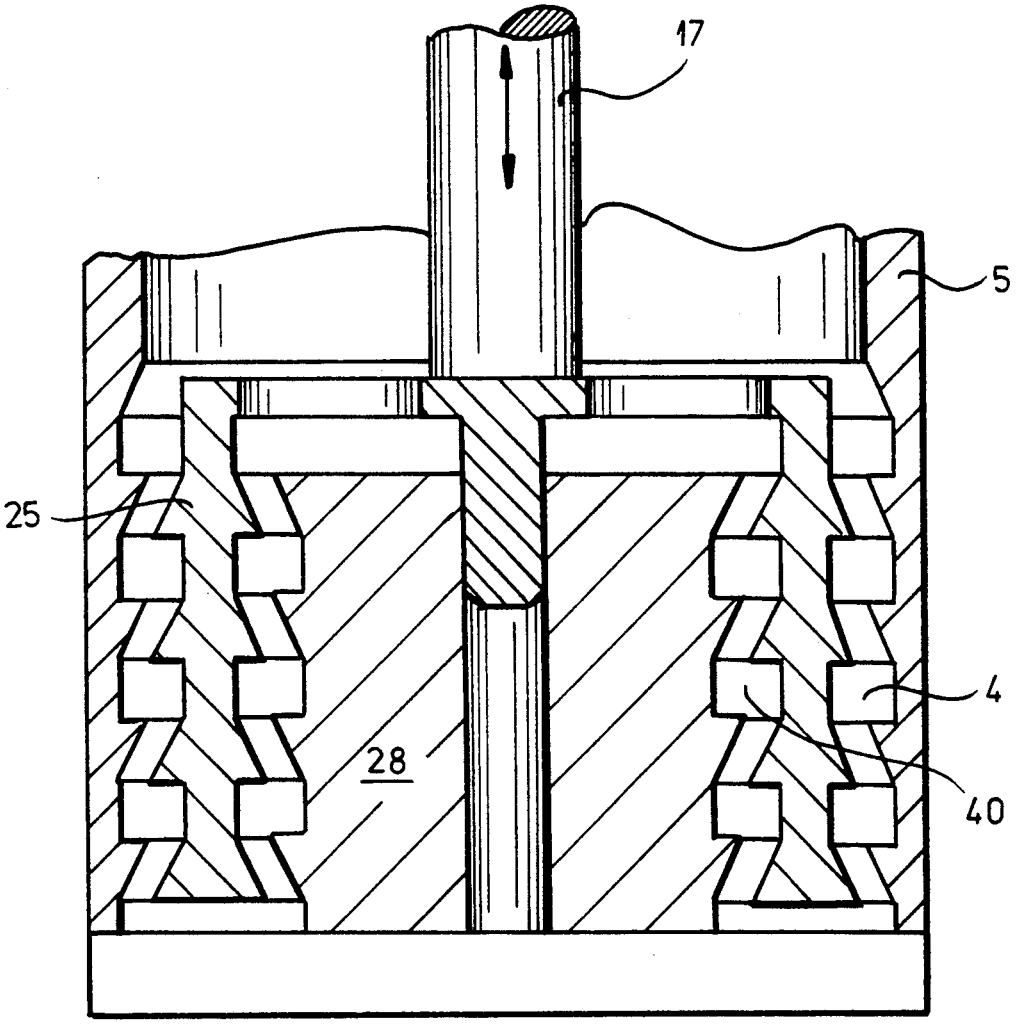
FIG. 6 is an enlarged cross sectional view of another in-line mixer for a system according to the invention.

In FIGS. 2A, 2B, 3A, 3B, 4A, 4B and 5A, 5B, only a single in-line annular chamber 4 is provided in the in-line mixer. In the embodiment of FIG. 6, by contrast, two parallel or concentric annular chambers 4, 40 are provided, the body 25 being an additional cylinder receiving an insert 28 which can be adjusted on the rod or stem 17 and can be moved therewith.

We claim:

1. An apparatus for mixing a fluid with a liquid, comprising:

combining means for combining a liquid with a fluid and including:

means forming a cylinder having a cylinder wall extending along an axis and defining at least one infusion chamber, inlet means communicating with said chamber at an upstream location for introducing said fluid into said infusion chamber, at least one radial aperture in said wall at a downstream location for injecting said liquid into said chamber, a chamber-closure plate with a solid upper surface spanned across said cylinder, axially displaceable in said cylinder and delimiting said chamber at an end thereof downstream from said inlet means, said plate having an outer edge controlling a flow cross section of said aperture and at least one discharge opening for discharging a mixture of said fluid with said liquid, and means connected with said plate for axially displacing same in said cylinder; and an in-line mixer connected to said cylinder for receiving said mixture from said chamber and intensifying mixing of said fluid with said liquid as said mixture flows through said in-line mixer.

2. The apparatus defined in claim 1 for mixing carbon dioxide as said fluid with an aqueous liquid in the preparation of a beverage, wherein said outer edge of said plate is formed as a collar on said plate and has a cross section converging in a direction opposite a direction of flow of said mixture through said chamber.

3. The apparatus defined in claim 2 wherein said discharge opening is formed as a diaphragm orifice.

4. The apparatus defined in claim 2 wherein down stream of said aperture said wall is formed with an inwardly open circumferentially extending cleaning groove having a height greater than that of said collar.

5. The apparatus defined in claim 2 wherein said cylinder is formed with a plurality of said infusion chambers disposed in succession along said cylinder and each delimited by a respective one of said plates.

6. The apparatus defined in claim 5 wherein four of said chambers are provided in said cylinder.

7. The apparatus defined in claim 5 wherein said plates are mounted upon a common rod.

8. The apparatus defined in claim 7 wherein said cylinder wall is surrounded, at least in a region of said radial apertures with an annular compartment communicating with said apertures and delivering said liquid thereto.

9. The apparatus defined in claim 8 wherein said inlet means includes at least one hole opening into an upstream one of said chambers through said cylinder wall, said apparatus further comprising a positioner on said cylinder at an upstream end thereof connected to said rod for axially shifting said plates.

10. The apparatus defined in claim 2 wherein said in-line mixer comprises at least one annular compartment axially traversed by said mixture and defined between two opposite walls having complementary turbulence-inducing formations.

11. The apparatus defined in claim 10 wherein an outer one of said opposite walls is formed as an extension of said cylinder walls, and an inner one of said opposite walls is formed as a body axially displaceable in said outer wall.

12. The apparatus defined in claim 11 wherein said body is mounted on said rod.

13. The apparatus defined in claim 11 wherein said formations are radial flanges so juxtaposed that said body can be shifted into a position blocking flow through the in-line mixer.

14. The apparatus defined in claim 11 wherein said formations have sawtooth profiles.

15. The apparatus defined in claim 1 wherein there are at least four of said radial apertures in said cylinder wall at said downstream location for injecting said liquid into said chamber.

16. An apparatus for mixing a fluid which is carbon dioxide with a liquid which is water in the preparation of a beverage, comprising:

combining means for combining a liquid with a fluid and including:

means forming a cylinder having a cylinder wall extending along an axis and defining at least one infusion chamber, inlet means communicating with said chamber at an upstream location for introducing said fluid into said infusion chamber, at last one radial aperture in said wall at a downstream location for injecting said liquid into said chamber, a chamber-closure plate spanned across said cylinder, axially displaceable in said cylinder and delimiting said chamber at an end thereof downstream from said inlet means, said plate having an outer edge controlling a flow cross section of said aperture and at least one discharge opening for discharging a mixture of said fluid with said liquid, said outer edge of said plate being formed as a collar on said plate and having a cross section converging in a direction opposite a direction of flow of said mixture through said chamber, said cylinder wall downstream from said aperture being formed with an inwardly open circumferentially extending groove having a height greater than that of a height of said collar, and means connected with said plate for axially displacing same in said cylinder; and an in-line mixer connected to said cylinder for receiving said mixture from said chamber and intensifying mixing of said fluid with said liquid as said mixture flows through said in-line mixer.

* * * * *